US006017242A

United States Patent [19]

Kerrigan

[11] Patent Number: 6,017,242

[45] **Date of Patent: *Jan. 25, 2000**

[54] RIGHT-ANGLED COAXIAL CABLE CONNECTOR

[75] Inventor: James J. Kerrigan, Andover, Mass.

[73] Assignee: Tensolite Company, Wilmington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,177

[22] Filed: May 28, 1997

Related U.S. Application Data

[63] Continuation of application No. 08/465,028, Jun. 5, 1995, abandoned.

[51] Int. Cl.[7] ..... H01R 13/56

[52] U.S. Cl. ..... 439/445; 439/473

[58] Field of Search ..... 439/473, 471, 439/468, 464, 445, 483, 484, 485, 489

[56] References Cited

U.S. PATENT DOCUMENTS

| | | | |
|---|---|---|---|
| 3,184,706 | 5/1965 | Atkins | 439/584 |
| 3,732,527 | 5/1973 | McKnight | 439/471 |
| 3,808,580 | 4/1974 | Johnson | 439/481 |
| 4,408,822 | 10/1983 | Nikitas | 439/583 |
| 4,564,255 | 1/1986 | Kirma | 439/471 |
| 4,580,862 | 4/1986 | Johnson | 439/585 |
| 4,863,396 | 9/1989 | Johnson | 439/470 |
| 4,869,687 | 9/1989 | Johnson | 439/470 |
| 5,074,805 | 12/1991 | Kirma | 439/452 |
| 5,570,443 | 10/1996 | May et al. | 439/468 |

*Primary Examiner*—Neil Abrams
*Assistant Examiner*—T C Patel
*Attorney, Agent, or Firm*—Herbert L. Bello

[57] ABSTRACT

A right angle connector includes a fixture for supporting a coaxial cable through a ninety degree angle made in close proximity to the connector. The connector is typically of standard configuration including a contact means, a ferrule, and crimp sleeve positioned within a casing. An engagement means functions to support that portion of the coaxial cable as it bends through the ninety degree angle and may be soldered to the cable.

21 Claims, 3 Drawing Sheets

RIGHT-ANGLED COAXIAL CABLE CONNECTOR

This is a continuation of application Ser. No. 08/465028 filed on Jun. 5, 1995, abandoned.

BACKGROUND OF THE INVENTION

1. Field of the Invention

The present invention relates to electrical connectors. It relates in particular to a right-angled coaxial cable connector.

2. Description of the Prior Art

Semi-rigid coaxial cabling is utilized in most high performance radio frequency applications. Such cabling typically consists of a central conductor material surrounded by an outer conductor material. While the central conductor material generally is a wire, the outer conductor typically is formed by braiding fine metallic threads. The central and outer conductors are separated by a non-conductive, dielectric material. An outer jacketing material can be employed to protectively encase the outer conductor material.

The use of coaxial cabling creates a need for connector systems capable of coupling segments of coaxial cabling with minimal detriment to electrical efficiency. To achieve maximum electrical efficiency, the cable segments must be axially and angularly aligned to high precision, as well as placed in mutual contact. The alignment and spacing requirements are exceedingly demanding due to the minute size of the inner conductor material. Satisfaction of these spacing and alignment requirements is difficult in those applications wherein the coaxial cabling must be bent in close proximity to the connector system. Especially problematic are those situations when, due to space or other limitations, the cabling must bend immediately upon exiting of the connector assembly.

Numerous systems have been developed to achieve the desired alignment of the conducting materials. Unfortunately, these connector systems are typically complex and to costly to manufacture. In addition, connections between available connectors and the coaxial cables to which they are attached frequently fail, i.e, signal interruption occurs, when the cable is bent in close proximity to the connector.

A need exists for a right-angled coaxial connector which is simple in construction and inexpensive to manufacture.

SUMMARY OF THE INVENTION

It is an object of the present invention to provide a right-angled coaxial connector which does not suffer from the foregoing disadvantages and limitations.

It is another object of the present invention to provide a right-angled coaxial cable connector that achieves consistent mechanical connection of segments of coaxial cabling.

It is yet another object of the present invention to provide a right-angled coaxial cable connector that is configured to maintain aligned connections between segments of coaxial cabling which are bent in close proximity to the connector.

It is yet another object of the present invention to provide a right-angled coaxial connector which is easily and economically produced, and readily assembled.

Other general and specific objects of the invention will in part be obvious and will in part appear hereinafter.

The right-angled coaxial cable connector of the present invention is characterized by a connecting means, a contact means, and a securing means. The connector also includes an insulating means that insulates the components of the invention from each other as well as maintains them in alignment.

The coaxial cable upon which the right-angled connector of the invention is positioned extends axially within the connector. That portion of the coaxial cable extending immediately outside of the end of the connector can be bent at an angle of up to about ninety degrees. The bent segment of the coaxial cable is supportingly secured in position by a fixture, that is, an engagement means, integral with the connecting means of the connector.

The connecting means is configured to receive the coaxial cable. Indeed, as noted above, the cable extends axially within the connecting means. The connecting means generally includes a ferrule means having a passage adapted to interferringly engage the cable. The engagement means noted above is integral with a peripheral edge of the connecting means and supportingly secures the cable as it bends through up to a ninety degree angle. The engagement means can be either a pair of appropriately positioned tangs or an arcuately extending lip. Finally, the connecting means can include a casing means that acts as a protective containment for the contact means. A securing means, for example, a coupling nut, is attached to the connecting means.

The contact means is contained within the connecting means. The contact means is joined directly to the coaxial cable. To insure accurate alignment of successive segments of connected cabling, the contact means is coaxially positioned relative to the cable.

The connector of the invention typically also includes a means for insulating the contact means from, for example, the connecting means. In operation, the insulating means maintains the contact means in a substantially coaxial position relative to the coaxial cable.

The invention accordingly comprises the steps and apparatus embodying features of construction, combinations of elements and arrangements of parts adapted to effect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
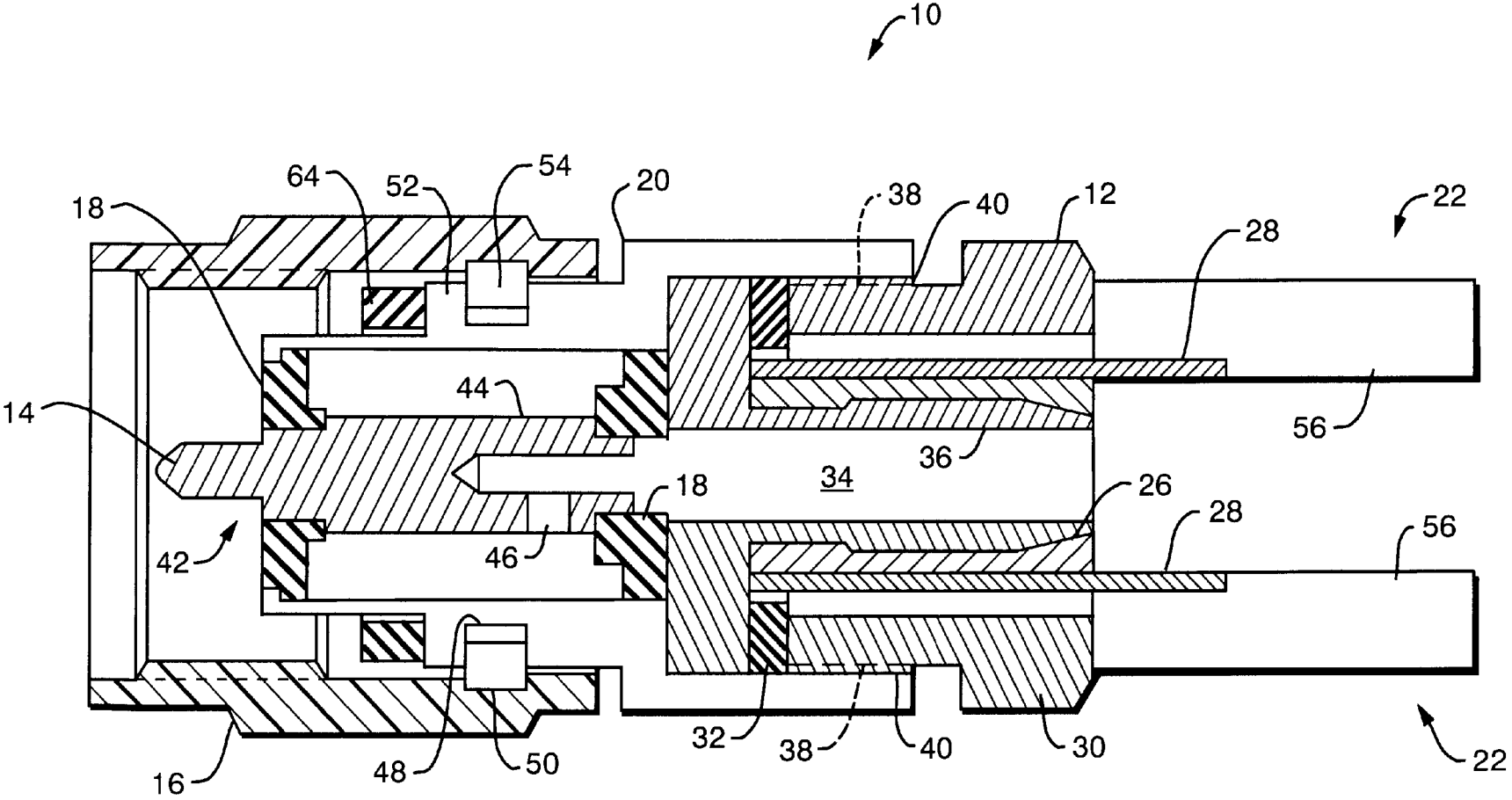
FIG. 1 is a side cut-away view of a right-angled coaxial cable connector embodying the invention.
Figure 2:
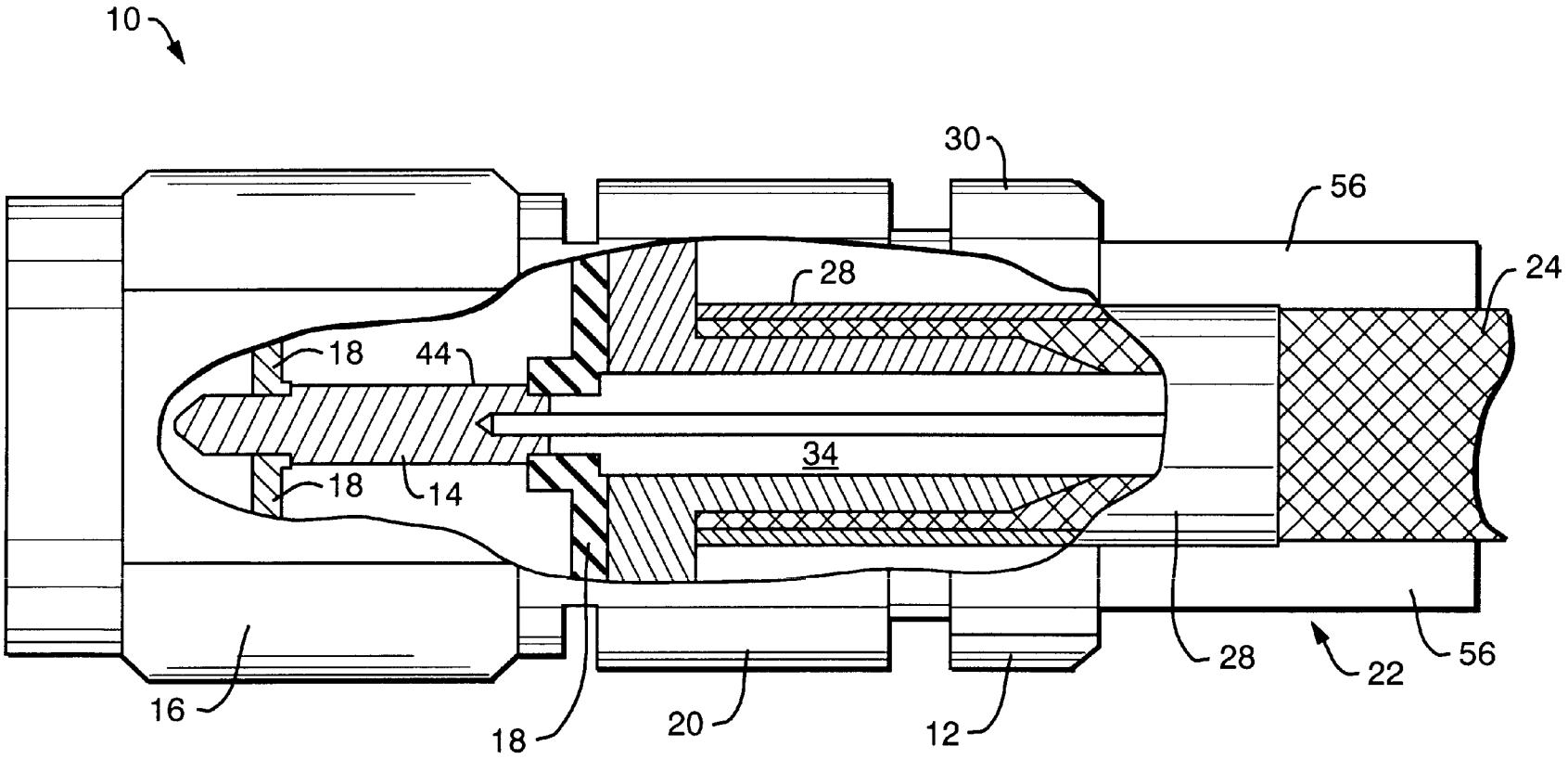
FIG. 2 is a side cut-away view of the right-angled coaxial cable connector of FIG. 1, showing a first configuration of the engagement means, with a coaxial cable extending therefrom.
Figure 3:
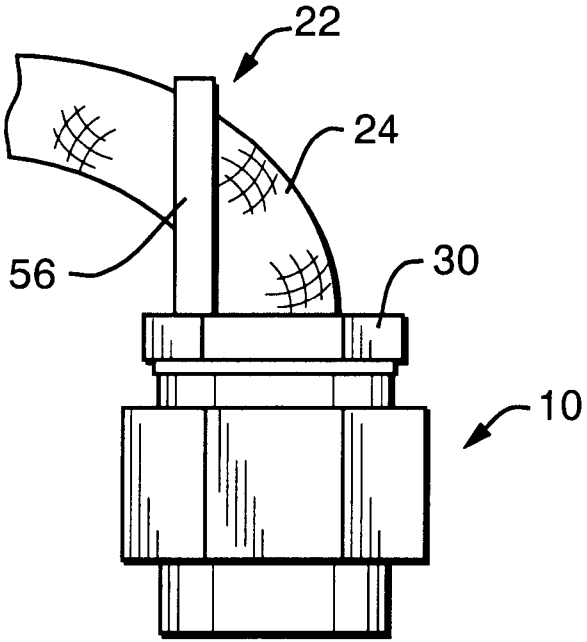
FIG. 3 is a side view of the right-angled coaxial cable connector of FIG. 1, showing the engagement means, with a coaxial cable extending therefrom.

Referring now to FIGS. 1 through 3, there is shown a right-angled coaxial cable connector 10. The connector 10 itself includes a connecting means 12, a contact means 14, a securing means 16, and an insulating means 18. A casing means 20 encases the contact means 14 and substantially all of the connecting means 12. An engagement means 22 extends away from the connecting means 12.

Referring now to FIG. 1, the connecting means 12 of the connector 10 is configured to receive a coaxial cable 24 as depicted in FIGS. 2 and 3. The connecting means 12 generally includes a ferrule 26, a crimp sleeve 28, and a back unit 30. The ferrule 26 and back unit 30 are separated by a washer 32. The washer 32 serves to assist in the alignment and spacing of all of the components of the connecting means 12. Typically, the washer 32 is formed of an insulating material.

The ferrule 26 has an annular configuration sized and shaped to receive the coaxial cable 24. In operation, the ferrule 26 maintains the coaxial cable 24 in axial alignment with the contact means 14. An inner passage 34 is in axial alignment with the contact means 14. Typically, the inner passage 34 is slightly flared in order to facilitate entry, and positioning, of the coaxial cable 24 in the ferrule 26. An inner surface 36 of the ferrule 26 is configured such that in operation it interferringly engages the outer conductor of the coaxial cable 24. The ferrule 26 is positioned within the casing means 20. The ferrule 26 acts as a support for the washer 32 and one end of the crimp sleeve 28. The thickness of the ferrule 26 can be modified as desired in order to provide adequate space for the washer 32 and crimp sleeve 28.

As shown best in FIG. 1, the crimp sleeve 28 typically is thin-walled and has an annular configuration. The crimp sleeve 28 is sized and shaped such that it can encase the ferrule 26 yet be positioned within the confines of the back unit 30. In addition, the crimp sleeve 28 is configured such that it makes substantially complete surface-to-surface contact with, for example, the outer conductor or jacketing material, of the coaxial cable 24. One end of the crimp sleeve 28 is preferably seated on the ferrule 26. The crimp sleeve 28 typically has an axial dimension selected so that at least a portion of it extends beyond the back unit 30. In order to facilitate compression of the crimp sleeve 28 into contact with the jacketing or outer conductor of the coaxial cable 24, the crimp sleeve 28 is composed of a ductile material.

Also of annular configuration, the back unit 30 extends axially rearward of the ferrule 26. The back unit 30 abuts the washer 32. The back unit 30 has a series of equally spaced extensions 38 designed to interferringly engage an inner surface 40 of the casing means 20. In operation, the extensions 38 secure the back unit 30 in place vis-a-vis the casing means 20. The back unit 30 has an inner diameter sufficient to contain the ferrule 26 and the crimp sleeve 28. The back unit 30 can be formed from virtually any suitable durable, machinable material. In the preferred embodiment of the invention, the back unit 30 is composed of brass or stainless steel.

The back unit 30 serves as a support for the engagement means 22. The engagement means 22 is configured to supportingly secure the coaxial cable 24 as it bends through an up to ninety degree, i.e., right, angle. In operation, the engagement means 22 insures that bending of the cable 24 will not cause separation from the connector 10. The operational and structural aspects of the engaging means 22 are discussed in detail below in connection with FIGS. 2 and 3.

The contact means 14 is contained within the casing means 20. The contact means 14 is joined to the end of the coaxial cable 24. To insure accurate alignment of successive segments of connected coaxial cabling 24, the contact means 14 is coaxially positioned relative to the coaxial cable 24, ferrule 26, back unit 30, and casing means 20. Generally, the contact means 14 has a rod-like configuration and is supported in position by insulating means 18. Those skilled-in-the-art will appreciate that the contact means 14 can be composed virtually any suitable material. In the preferred embodiment of the invention as depicted in the FIGURES, the contact means 14 is composed of, for example, brass or stainless steel.

The contact means 14 has a forward portion 42 and rearward portion 44. The forward portion 42 is configured as a male connector. Male connector can have virtually any size and shape that permits connection of the connector 10 to another connector 10 as desired. The rearward portion 44 is configured as a female connector. The female connector is sized and shaped to permit attachment of the contact means 14, and hence connector 10, to the end of the inner conductor of the coaxial cable 24. A vent 46 is drilled radially through the rearward portion 44 to provide an exit for that air trapped in the female connector of rear portion 44 and passage 34 of the ferrule 26 during positioning of the connector 10 on the coaxial cable.

Supporting the contact means 14 are insulating means 18. The insulating means 18 are generally disk-shaped and have a central aperture configured to receive the contact means 14. The insulating means 18 can be composed virtually any suitable material exhibiting the desired insulating qualities. In the preferred embodiment of the invention as depicted in the FIGURES, the insulating means 18 is composed of plastic.

The ferrule 26, washer 32, contact means 14, and insulating means 18 are contained within the casing means 20. In the preferred embodiment of the invention as shown in the FIGURES, the casing means 20 has a generally tubular configuration. A forward portion of the casing means 20 has a groove 48 complementary in position to a groove 50 in securing means 16. On one side, the groove 48 is defined by lan 52. In the preferred embodiment of the invention, a gasket 64 is positioned against the forward face of the lan 52. The groove 48 is sized and shaped such that it can receive a locking ring 54. Once positioned in the grooves 50 and 48 of the securing means 16 and casing means 20, respectively, the locking ring 54 secures the securing means 16 and casing means 20 together. A rearward portion of the casing means 20 is configured to contain the ferrule 26, crimp sleeve 28, and back unit 30.

The securing means 16 is mounted on the forward portion of the casing means 20. In the preferred embodiment of the invention as shown in the FIGURES, the securing means 16 is sized and shaped so as to encase at least a portion of the casing means 20. Typically, the securing means 16 has a tubular configuration. As noted above, the securing means 16 includes a groove 50 for receiving the locking ring 54. Externally, the securing means 16 typically has a polygonal configuration that provides a means for the mechanical manipulation of the securing means 16. In the preferred embodiment of the invention as depicted in the FIGURES, the securing means 16 is composed of brass or stainless steel.

As shown best in FIGS. 1, 2 and 3, in one embodiment of the invention the engagement means 22 are a pair of tangs 56 extending axially from the back unit 30. When utilized, the tangs 56 have a length sufficient to supportingly engage, i.e., be soldered to, the coaxial cable 24 at a selected point as the cable bends through an up to about ninety degree arc.

To facilitate the desired supporting engagement between the tangs 56 and coaxial cable 24, the tangs 56 are separated by a distance equal to, or slightly less than, the diameter of the coaxial cable 24 to which the connector 10 is to be connected.

Figure 4:
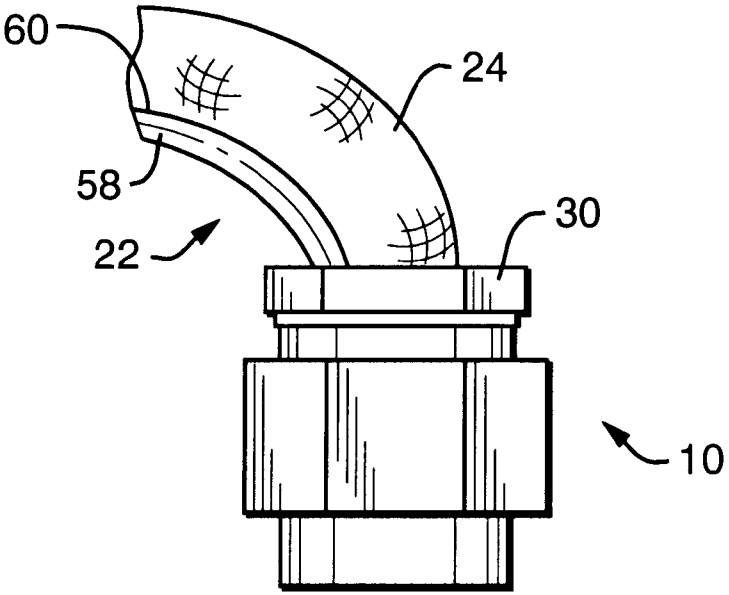
FIG. 4 is a side view of the right-angled coaxial cable connector of FIG. 1 showing a second configuration of the engagement means with a coaxial cable extending therefrom.

Alternatively, as depicted in FIG. 4, the engagement means 22 can be an arcuate lip 58 extending away from the back unit 30. When used, the lip 58 is configured such that it has a supporting surface 60 complementary to the external configuration of the coaxial cable 24. In operation, the cable 24 is typically soldered to the surface 60 of the lip 58. Like tangs 56, lip 58 is sized so as to provide support for the coaxial cable as it bends through an up to about ninety degree arc.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A right-angled connector for use with a coaxial cable, said connector comprising:

(a) a coaxial cable having an outer conductor jacket;

(b) a connecting means, said connecting means having a body that is adapted to receive the coaxial cable, the coaxial cable being received within said body and extending from said connecting means, the coaxial cable extending from said connecting means being bent immediately as it exits said connecting means at an angle relative to a longitudinal axis of said connecting means, said connecting means having an integral, non-rotatable engagement means extending therefrom, said engagement means securing the coaxial cable to said connecting means, said engagement means extending away from said body of said connecting means, said engagement means having a supporting surface configured to receive and support the coaxial cable, said supporting surface defining a template for bending the cable immediately as it exits said connecting means, said supporting surface supporting the coaxial cable as it exits said connecting means, said template provided by said supporting surface assisting to prevent damage to the coaxial cable during bending of the cable immediately as it exits said connecting means, said engagement means having a first portion and a second portion, said first portion and said second portion being joined together so as to form a continuous supporting surface, said engagement means extending along an arcuate path such that said first portion is at an angle relative to said second portion, said angle between said first portion and said second portion of said engagement means being selected such that said supporting surface of said engagement means and the coaxial cable are in substantially surface-to-surface contact as the coaxial cable extends away from said connecting means, said engagement means being configured to supportingly secure the bent extending coaxial cable, the coaxial cable being supported by said engagement means at an angle relative to said body of said connecting means, said outer conductor jacket being soldered to said engagement means said coaxial cable being permanently and rigidly fixed to said engagement means;

(c) a contact means positioned within said body of said connecting means and fixable to the coaxial cable; and (d) a securing means attached to said body of said connecting means.

2. The apparatus of claim 1 wherein said connecting means includes a ferrule means, said ferrule means being sized and shaped to interferringly engage the coaxial cable.

3. The apparatus of claim 1 wherein said engagement means is sized and shaped to interferringly engage opposing sides of the coaxial cable.

4. The apparatus of claim 3 wherein said engagement means are integral with an external surface of said connecting means.

5. The apparatus of claim 1 wherein said connecting means further includes a casing means, said casing means encasing substantially all of said contact means.

6. The apparatus of claim 5 further including a means for insulating said contact means from said casing means, said insulating means maintaining said contact means in a position substantially coaxial with the coaxial cable.

7. The apparatus of claim 1 wherein said securing means is a coupling nut.

8. A right-angled connector for use with a coaxial cable, said connector comprising:

(a) a coaxial cable having an outer conductor jacket;

(b) a connecting means having a body and engagement means, said body having an axially extending passage, said passage being adapted for receiving the coaxial cable, the coaxial cable extending from said connecting means being bent immediately as it exits said connecting means at an angle relative to a longitudinal axis of said connecting means;

(c) said engagement means being non-rotatable and integral with said body of said connecting means, said engagement means securing the coaxial cable to the connecting means, said engagement means having a supporting surface, said supporting surface acting as a template for bending the cable immediately as it exits said connecting means, said supporting surface supporting the coaxial cable received in said connecting means, said template provided by said supporting surface assisting to prevent damage to the coaxial cable during bending of the cable immediately as it exits said connecting means, said engagement means having an arcuate configuration such that one portion of said engagement means is substantially perpendicular to another portion of said engagement means, said portions of said engagement means being joined together so as to form a continuous supporting surface, said engagement means being configured to supportingly secure the coaxial cable at a right angle relative to said connecting means, said supporting surface of said engagement means and the coaxial cable being in substantially surface-to-surface contact when the coaxial cable is connected to said connecting means, said outer conductor jacket being soldered to said engagement means said coaxial cable being permanently and rigidly fixed to said engagement means;

(d) a contact means contained within said body of said connecting means and being fixable to the coaxial cable;

(e) a casing means, said casing means being in supporting engagement with said body of said connecting means, said casing means encasing substantially all of said contact means; and (f) a securing means attached to said body of said connecting means.

9. The apparatus of claim 8 wherein said connecting means includes a ferrule means having a passage adapted for receiving the coaxial cable, an inner surface of said passage interferringly engaging the coaxial cable.

10. The apparatus of claim 8 wherein said engagement means is sized and shaped to interferringly engage opposing sides of the coaxial cable.

11. The apparatus of claim 10 wherein said engagement means is integral with an external surface of said connecting means.

12. The apparatus of claim 8 wherein said engagement means is sized and shaped to supportingly engage an outer surface of the coaxial cable.

13. The apparatus of claim 8 wherein said connecting means further includes a means for insulating said contact means from said casing means.

14. The apparatus of claim 8 wherein said securing means is a coupling nut.

15. A right-angled connector for use with a coaxial cable having anouter conductor jacket, said connector comprising:

(a) a connecting means having a body and a fixed engagement means, said body having a first end and a second end, said body having an axially extending passage extending along a connector axis, said axially extending passage being adapted for coaxially receiving the coaxial cable, the coaxial cable extending from said connecting means being bent immediately as it exits said connecting means at an angle relative to a longitudinal axis of said connecting means;

(b) a contact means contained within said body and extending from said first end thereof, said contact means being fixable to the coaxial cable, said contact means being coaxially aligned with said connector axis of said axially extending passage of said body, the coaxial cable extending from said second end of said body;

(c) said fixed engagement means extending outwardly from said connecting means at said second end of said body, said fixed engagement means being fixed to said connecting means so as to provide an immobile supporting surface for capturing and holding the coaxial cable, said fixed engagement means being non-rotatable relative to said body and having a rigid support configured to provide a template for bending the coaxial cable immediately as it exits said connecting means, said supporting surface supporting the coaxial cable received in said connecting means, said template provided by said supporting surface assisting to prevent damage to the coaxial cable during bending of the coaxial cable immediately as it exits said connecting means, said rigid support of said engagement means being configured to captively hold and supportingly secure the coaxial cable at a selected angle relative to said connector axis of said axially extending passage; the outer conductor jacket of the coaxial cable being soldered to said fixed engagement means, the coaxial cable being permanently and rigidly fixed to said fixed engagement means; and (d) a securing means attached to said connecting means.

16. The right-angled connector as claimed in claim 15 wherein said selected angle is substantially a right angle, a coaxial cable fixed to said contact means and extending from said second end of said body being disposed and supportingly held at a substantially right angle to said connector axis by said engagement means.

17. The right-angled connector as claimed in claim 15 including a casing means, said casing means being in supporting engagement with said body of said connecting means, said casing means encasing substantially all of said contact means.

18. A right-angled connector for use with a coaxial cable, said connector comprising:

(a) a coaxial cable having an inner conductor and an outer conductor, a dielectric body electrically isolating the inner and outer conductors said outer conductor being a jacket of said coaxial cable;

(b) a connecting means having an inner contact means and an outer contact means, said inner contact means and said outer contact means being electrically insulated from one another, said connector means configured to receive the coaxial cable, one end of the coaxial cable received in said connecting means with the inner conductor of the coaxial cable being in electrical contact with said inner contact means and the outer conductor of the coaxial cable being in electrical contact with the outer contact means, the inner and outer conductors of the coaxial cable being electrically isolated from one another when secured in said connector means, the coaxial cable extending outwardly from said connecting means, the coaxial cable extending from said connecting means being bent immediately as it exits said connecting means at an angle relative to a longitudinal axis of said connecting means, said connecting means having an integral, non-rotatable, rigid fixture means extending therefrom;

(c) said rigid fixture means configured to supporting secure the coaxial cable extending outwardly from said connecting means at an angle offset from a longitudinal axis of said connecting means, said rigid fixture means including a supporting surface means configured to act as a template for bending the coaxial cable immediately as it exits said connecting means, said rigid fixture means extending from said connecting means so that the position of said supporting surface relative to said connecting means is fixed, said supporting surface acting as a template during bending of the coaxial cable immediately as it exits said connecting means so as to prevent damage to the coaxial cable during bending, said outer conductor of the coaxial being soldered to said rigid fixture means, the coaxial cable being permanently and rigidly fixed to said rigid fixture means.

19. The apparatus of claim 18 wherein said fixture means is a pair of tangs, said tangs being sized and shaped to engage and support the coaxial cable extending outwardly from said connecting means at an angle offset from a longitudinal axis of said connecting means.

20. The apparatus of claim 18 wherein said fixture means is an arcuate lip that extends outwardly from said connecting means, said lip being sized and shaped to form a guide for bending and supporting the coaxial cable extending outwardly from said connecting means at an angle offset from a longitudinal axis of said connecting means.

21. The apparatus of claim 18 wherein said fixture means is an integral part of said connecting means at an angle offset from a longitudinal axis of said connecting means.

* * * * *